US006758305B2

(12) United States Patent
Gelin et al.

(10) Patent No.: US 6,758,305 B2
(45) Date of Patent: Jul. 6, 2004

(54) COMBINATION SOUND-DEADENING BOARD

(75) Inventors: Lawrence J. Gelin, Littleton, CO (US); Brandon D. Tinianov, Littleton, CO (US); Steve Dawson, Denver, CO (US); Mauro Vittorio Battaglioli, Lone Tree, CO (US); Ralph Michael Fay, Lakewood, CO (US); Francis Babineau, Parker, CO (US)

(73) Assignee: Johns Manville International, Inc., Denver, CO (US)

( * ) Notice: Subject to any disclaimer, the term of this patent is extended or adjusted under 35 U.S.C. 154(b) by 79 days.

(21) Appl. No.: 09/981,491

(22) Filed: Oct. 16, 2001

(65) Prior Publication Data

US 2002/0092703 A1 Jul. 18, 2002

Related U.S. Application Data

(60) Provisional application No. 60/261,171, filed on Jan. 16, 2001.

(51) Int. Cl.[7] ..... E04B 1/00; E04B 1/82; E04B 2/02

(52) U.S. Cl. ..... 181/285; 181/286; 181/290; 52/144

(58) Field of Search ..... 181/285, 286, 181/290, 295; 52/144, 145

(56) References Cited

U.S. PATENT DOCUMENTS

| | | | | | |
|---|---|---|---|---|---|
| 3,828,504 | A | * | 8/1974 | Egerborg et al. | 181/285 |
| 4,346,782 | A | * | 8/1982 | Bohm | 181/294 |
| 4,705,139 | A | * | 11/1987 | Gahlau et al. | 181/290 |
| 5,088,576 | A | * | 2/1992 | Potthoff et al. | 181/290 |
| 5,304,415 | A | * | 4/1994 | Kurihara et al. | 181/290 |
| 5,974,757 | A | * | 11/1999 | Whitney et al. | 52/586.1 |
| 6,420,447 | B1 | * | 7/2002 | Kittel et al. | 181/290 |

FOREIGN PATENT DOCUMENTS

| | | | | | |
|---|---|---|---|---|---|
| JP | 01165871 | A | * | 6/1989 | E04F/15/18 |
| JP | 09111909 | A | * | 4/1997 | E04B/1/86 |
| JP | 09119177 | A | * | 5/1997 | E04B/1/86 |
| JP | 09228536 | A | * | 9/1997 | E04B/9/00 |
| JP | 09256503 | A | * | 9/1997 | E04B/1/86 |

* cited by examiner

*Primary Examiner*—Kimberly Lockett
*Assistant Examiner*—Edgardo San Martin
(74) *Attorney, Agent, or Firm*—Robert D. Touslee

(57) ABSTRACT

A sound-deadening laminate, comprising a structural skin having a first face; and a layer of sound-deadening material, wherein the material has an equivalent Young's Modulus between 50 and 600 psi and is attached to the first face of the structural skin to form a laminate structure. The sound deadening laminate may be attached to framing members of a building.

8 Claims, 3 Drawing Sheets

COMBINATION SOUND-DEADENING BOARD

This application claims the benefit of provisional application No. 60/261,171 filed Jan. 16, 2001.

BACKGROUND OF THE INVENTION

The present invention relates generally to building materials and more particularly to materials used for sound insulation.

In building modern structures, such as single-family houses or commercial buildings, an important factor to consider is noise control. In order to provide a quiet environment, sounds originating from sources such as televisions or conversation must be controlled and reduced to comfortable sound pressure levels. To achieve such an environment, builders and designers must address a multitude of factors, among them the construction and composition of building component assemblies that separate rooms from other rooms or from the outside environment. Such assemblies may, for example, take form as interior walls, exterior walls, ceilings, or floors of a building.

The term "transmission loss": is expressed in decibels (dB) and refers to the ratio of the sound energy striking an assembly to the sound energy transmitted through the assembly. A high transmission loss indicates that very little sound energy (relative to the striking sound energy) is being transmitted through an assembly. However, transmission loss varies depending on the frequency of the striking sound energy, i.e., low frequency sounds generally result in lesser transmission loss than high frequency sounds. In order to measure and compare the sound performances of different materials and assemblies (i.e., their abilities to block or absorb sound energy), while also taking into account the varying transmission losses associated with different sound frequencies, builders and designers typically use a single-number rating called Sound Transmission Class (STC), as described by the American Society For Testing and Materials (ASTM). This rating is calculated by measuring, in decibels, the transmission loss at several frequencies under controlled test conditions and then calculating the single-number rating from a prescribed method. When an actual constructed system is concerned (i.e., where conditions such as absorption and interior volume are not controlled in a laboratory environment), the single-number rating describing the acoustical performance of such a system can be expressed as a field STC rating (FSTC), which approximates a STC rating when tested on-site. The higher the FSTC rating of a constructed system, the greater the transmission loss.

A conventional wall assembly 300 (called a wood stud wall) is shown in FIG. 3 and consists of two gypsum boards 303 (also referred to as drywall or sheetrock skins) attached directly to either sides of wood studs 301. The space between the wood studs 301 may be filled with some type of fibrous insulation 305 (e.g., fiber glass batts). A wall assembly such as assembly 300 generally results in transmission loss values between STC 30 and STC 36, because although the cavity area between the wood studs 301 is filled with sound insulation material 305, sound energy can easily pass through the structural connections between the wood studs 301 and the gypsum boards 303. Accordingly, assembly 300 is generally ineffective in reducing sound energy transmission.

Several methods are currently used by builders to produce wall and ceiling/floor assemblies with higher FSTC ratings than the performance of a basic wood stud configuration. One such method is the use of resilient channels in a wall assembly 400, shown in FIG. 4*a*. This method involves inserting one or more thin metal channels 407 between one of the drywall skins 403 and framing members 401. The resilient channels 407 act as shock absorbers, structural breaks, and leaf springs, reducing the transmission of vibrations between a drywall skin 403 and the framing members 401. However, the resilient channel technique is difficult to install correctly and requires excessive labor costs. It is very easy to "short out" a resilient channel 407 by improper nailing techniques (e.g., screwing long screws into the wood studs 401 behind the resilient channel 407). When this occurs, the sound isolation of wall assembly 400 remains unimproved. Similarly, problems relating to the difficulty of installing resilient channels may result when the technique is used to sound-isolate floor-ceiling assemblies.

The use of resilient channels also increases the overall thickness of a wall or floor-ceiling assembly by at least ½ inch. This increase may prevent a builder or designer from using standard components that typically interface with a wall or floor-ceiling assembly. An example of such a component may be a doorjamb, where the increase in a wall assembly may necessitate the use of an expensive, non-standard size door jamb.

Other current practices involve staggering the positions of wall studs 401 (as illustrated in FIG. 4*b*) or using double stud construction (as illustrated in FIG. 4*c*). These methods create a larger cavity depth and can reduce the structural connections between wall assembly components 401 and 403, thereby allowing an assembly 400 to achieve relatively high FSTC ratings. However, both of these methods double the cost of framing and increase the thickness of wall assembly 400 by approximately two to four inches, which increases installation and material costs as described above.

In addition, various sound absorbing or barrier materials are currently used to provide a structural break between wall studs or floor-ceiling joists and the boards attached to them. Examples of such materials include GyProc® by Georgia-Pacific Gypsum Corporation and 440 Sound-A-Sote™ by Homasote and Temple-Inland SoundChoice™. While capable of providing additional sound-transmission loss, these materials are generally dense and heavy, resulting in high handling and installation costs.

Accordingly, what is needed is a low-cost material between the framing members and building boards either in sheets or strips that can be installed in wall or floor-ceiling assemblies to provide additional substantial acoustical performance, while requiring less installation steps than current practices and allowing the use of standard size components to interface with the assemblies.

SUMMARY OF THE INVENTION

The present invention is directed to a combination sound-deadening board that is economical and provides relatively high acoustical performance improvement.

According to a first embodiment of the present invention, a combination sound-deadening board is provided, comprising a layer of structural skin, and a layer of sound-deadening material, wherein the material has an equivalent Young's Modulus (bulk modulus of elasticity) between 50 and 600 pounds per square inch (psi) and a thickness between ¼ and 1 inch, and is attached to the layer of structural skin to form a single laminate structure. This Young's Modulus may be achieved through means of basic material properties (true Young's Modulus), or by the physical alteration of the board to make the modulus appear lower when installed in the described manner. Kerfing, grooving, waffle cuts and boring are all examples of such alterations.

According to a second embodiment of the present invention, a building component assembly is provided, comprising at least one assembly framing member, and at least one combination sound-deadening board that is a single laminate structure comprising a structural skin layer attached to a sound-deadening material, wherein the sound-deadening material has an equivalent Young's Modulus (bulk modulus of elasticity) between 50 and 600 pounds per square inch and a thickness between ¼ and 1 inch, and that at least one combination sound-deadening board is attached to the assembly framing member such that the sound-deadening material faces the assembly framing member. Kerfing, grooving, waffle cuts and boring are all examples of such alterations.

BRIEF DESCRIPTION OF THE DRAWINGS

Other objects and advantages of the present invention will become more apparent from the following detailed description of preferred embodiments, when read in conjunction with the accompanying drawings wherein like elements have been represented by like reference numerals and wherein.

DETAILED DESCRIPTION OF THE INVENTION

Figure 5:
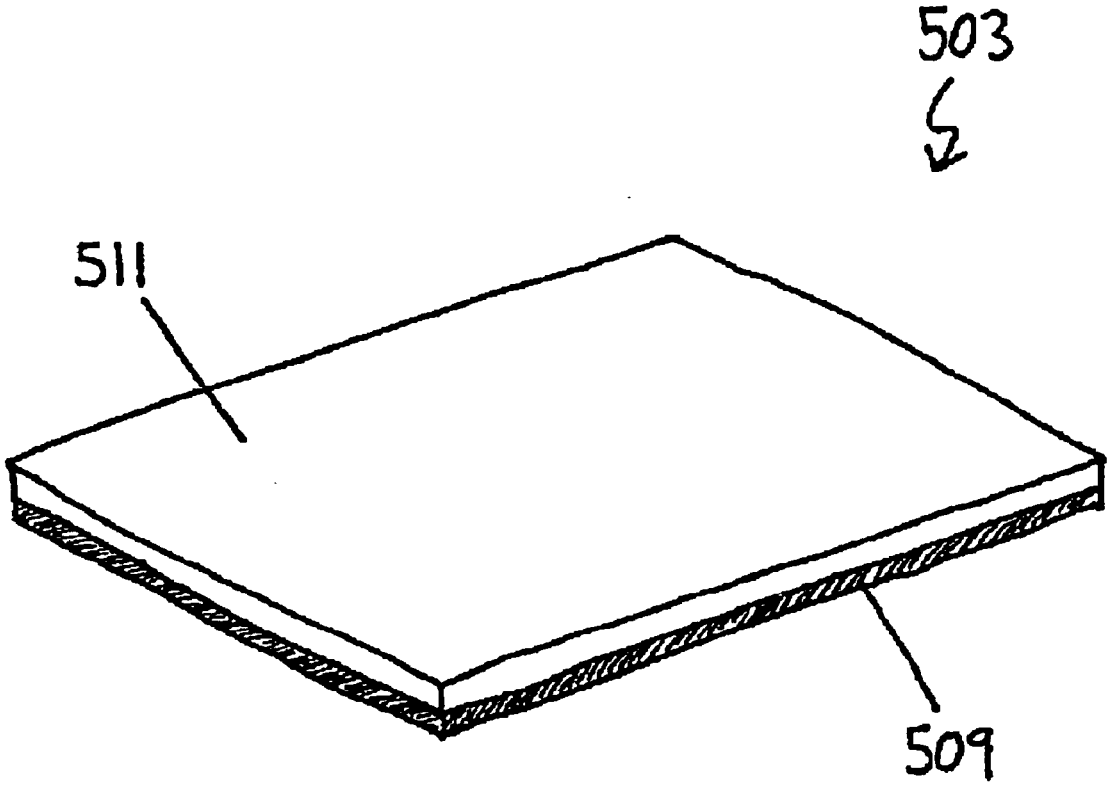
FIG. 5 illustrates a combination sound-deadening board in accordance with the present invention.

FIG. 5 illustrates a combination sound-deadening board 503, which includes a structural skin side 511 and a sound-deadening side 509. Skin side 511 may be in the form of conventionally-known wallboards (also called leaves), such as plywood, plasterboard, or gypsum board. Sound-deadening side 509 is made of a sound-deadening material, which is described below. The two full-sheet sides 509 and 511 are attached or adhered in such a way that they form a single laminate, that is, board 503. In other words, sides 509 and 511 can be transported and installed as a single multi-layer board 503. The attaching process that creates multi-layer board 503 may occur either during the manufacturing of the structural skin or may occur as a secondary step.

Figure 1:
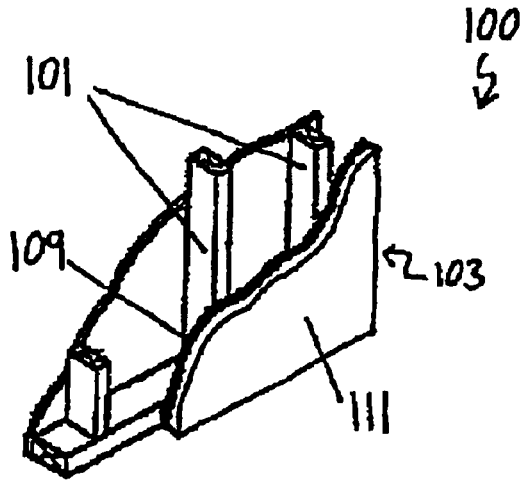
FIG. 1 illustrates a wall assembly built in accordance with the present invention.

FIG. 1 illustrates a wall assembly 100 including wall studs 101 and a combination sound-deadening board 103. Studs 101 maybe standard wall studs, made of either wood or metal (e.g., steel), and may be lightweight (25 gauge) or heavyweight (20, 18, or 16 gauge). As seen in the figure, board 103 is attached to studs 101 in such a way that sound-deadening side 109 is positioned between skin side 111 and each study 101. In this way, sound-deadening side 109 reduces vibration transmission between side 111 and the studs 101, resulting in enhanced sound isolation between rooms located on either side of assembly 100. Analytical modeling and laboratory testing has shown that optimum sound control performance results when sound-deadening side 109 has a Young's Modulus (bulk modulus of elasticity) between 50 and 600 pounds per square inch, a value much lower than the stiffness values associated with conventional materials used in building wall or floor-ceiling assemblies (e.g., gypsum boards and wood studs). Modeling and testing also showed that materials with an equivalent Young's Modulus (bulk modulus of elasticity) between 50 and 500 pounds per square inch were found to offer broadband improvements with a maximum of 6 to 8 dB improvement at the 1600 Hz one-third octave band. More specifically, materials with an equivalent Young's Modulus (bulk modulus of elasticity) between 500 to 600 pounds per square inch were found to offer broadband improvements with a maximum of 3 to 4 dB improvement at the 1600 Hz one-third octave band. Therefore, materials with Young's Moduli within the described range offer the best sound control performance while materials with higher Young's Moduli offer some improvement in terms of sounds transmission loss.

Existing materials that possess Young's Modulus values less than those of conventional wall or floor-ceiling assembly materials are not currently being used in sound-control applications. An example of such a material that is also non-resiliently compressible is isocyanurate foam sheathing (also called "iso foam"), which is currently used only for thermally insulating exterior walls and not for sound-deadening interior wall or floor-ceiling assemblies. Another example is blue closed cell sill seal foam, a non-resiliently compressional material also not normally used for sound-deadening interior wall or floor-ceiling assemblies. Of course, any material with Young's Modulus less than the Young's Modulus values of conventional wall or floor-ceiling assembly materials may be used in the present invention as sound-deadening side 109. As described above, however, a preferred range of sound control performance results when the material has a Young's Modulus from 50 to 600 psi.

Sound-deadening side 109 preferably has a thickness of between about 0.125 to 1 inch and may be manufactured from a wide variety of materials, including, but not limited to, a cellulosic fiber material (e.g., recycled newsprint), perlite, fiber glass, EPDM rubber, or latex. Side 109 also is preferably manufactured to a density of 9 to 14 pounds per cubic foot, which is less than the density of current sound-control boards. For example, 440 Sound-A-Sote™ has a density of 26 to 28 pounds per cubic foot and Temple-Inland SoundChoice™ has a density of 15 to 20 pounds per cubic foot. The material of side 109 is therefore much lighter and less stiff than current sound-control boards, resulting in higher ease of handling and lower installation costs. Testing has shown that the installation of a sound-deadening material such as sound-deadening side 109 between the skins and studs of a wall assembly can yield STC ratings of 41 or higher. In contrast, an unimproved wall assembly, as mentioned before, has a maximum STC rating of about 36.

Figure 2:
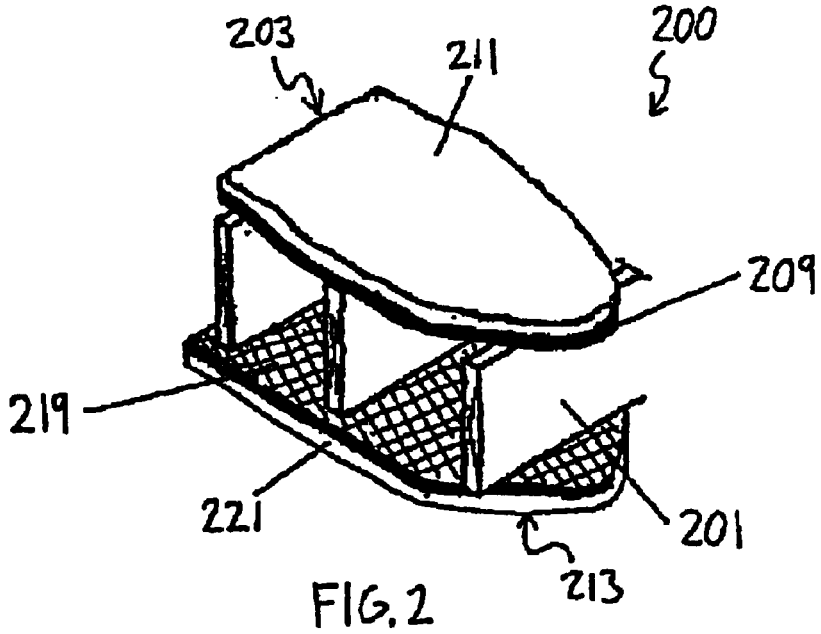
FIG. 2 illustrates a floor-ceiling assembly built in accordance with the present invention.
Figure 3:
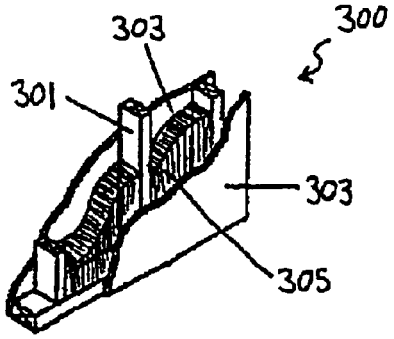
FIG. 3 PRIOR ART
FIG. 3 illustrates a conventional wall assembly.
Figure 4A:
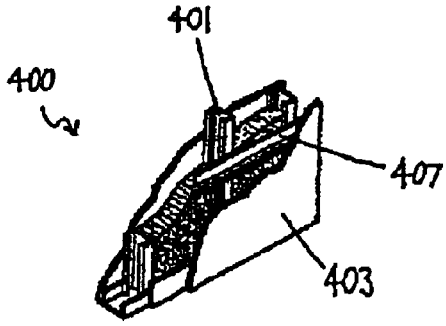
FIG. 4a PRIOR ART
FIGS. 4*a*–4*c* illustrate conventional methods of sound control in wall assemblies.
Figure 4B:
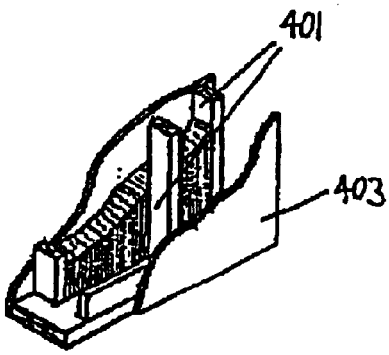
FIG. 4b PRIOR ART
Figure 4C:
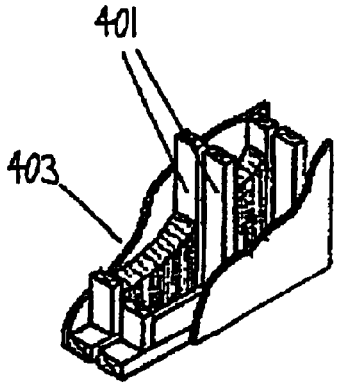
FIG. 4c PRIOR ART

FIG. 2 shows another application of combination sound-deadening boards having a sound-deadening side meeting the above-described requirements (i.e., the requirements for compressional stiffness, thickness, and density). In floor-ceiling assembly 200, a board 203 is attached in such a way that a sound-deadening side 209 is positioned between a floor skin side 211 and joists 201. Board 213 is attached in such a way that a sound-deadening side 219 is positioned between a ceiling skin side 221 and the other sides of joists 201. Sound-deadening side 209 and sound-deadening side 219 may both be made of the same material, or may be made of two different materials, each meeting the above-described requirements. Of course, assembly 200 may include only one of the two combination boards 203 and 213 (meaning that only one board includes attached sound-deadening material), or may include both as shown. STC ratings of approximately 50 may be achieved in such a configuration as floor-ceiling assembly 200.

The installation of combination sound-deadening board 103 (and board 203) is far less complex than conventional sound control methods for wall and floor-ceiling assemblies. In fact, installers using such a board would simply cut the board to a desired size and attach it (e.g., using conventional gas or fluid-powered automatic fasteners) to a stud or joist just as they would with conventional gypsum board, keeping in mind, however, that the side of the board made of sound-deadening material must be positioned against the stud or joist. In this way, the steps of installing structural skin and sound-deadening material are combined into one step, providing an economical method of achieving a high acoustical performance in a wall or floor-ceiling assembly. In addition, the simplicity of board installation also establishes high confidence that a wall or floor-ceiling assembly installed with the board will perform as specified by a building designer. Further, the use of a combination sound-deadening board as described above may allow a builder or designer to use standard size interfacing components (e.g., door jambs) because the installation of such a board would not greatly increase the thickness of a wall or floor-ceiling assembly. Also, a combination sound-deadening board possessing the above-described characteristics may also provide some type of thermal benefit (e.g., if the sound-deadening side is made of A/P foam sheathing) and/or moisture control.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A combination sound-deadening board, comprising:

a layer of structural skin; and a layer of sound-deadening material, wherein the material has an equivalent Young's Modulus between 50 and 600 psi and is attached to the layer of structural skin to form a single laminate structure.

2. A building component assembly, comprising:

at least one combination sound-deadening board that is a single laminate structure comprising a structural skin layer attached to a sound-deadening material, wherein the sound-deadening material has an equivalent Young's Modulus between 50 and 600 psi, and the at least one combination sound-deadening board is attached to the assembly framing member such that the sound-deadening material faces the assembly framing member.

3. A combination sound-deadening board according to claim 1, the sound deadening board having a weight density less than or equal to about 14 pounds per cubic foot.

4. A combination sound-deadening board according to claim 1, the sound deadening board having a weight density between about 9 and about 14 pounds per cubic foot.

5. A building component assembly according to claim 2, the sound deadening board having a weight density less than or equal to about 14 pounds per cubic foot.

6. A building component assembly according to claim 2, the sound deadening board having a weight density of between about 9 and about 14 pounds per cubic foot.

7. The combination sound-deadening board according to claim 4, wherein the layer of sound deadening material has a thickness between ¼ and 1 inch.

8. The building component assembly according to claim 6, wherein the sound deadening material has a thickness between ¼ and 1 inch.

* * * * *